US005479188A

United States Patent [19]

Moriyama

[11] Patent Number: 5,479,188

[45] Date of Patent: Dec. 26, 1995

[54] METHOD FOR DRIVING LIQUID CRYSTAL DISPLAY PANEL, WITH REDUCED FLICKER AND WITH NO STICKING

[75] Inventor: Hiroaki Moriyama, Tokyo, Japan

[73] Assignee: NEC Corporation, Tokyo, Japan

[21] Appl. No.: 253,180

[22] Filed: Jun. 2, 1994

[30] Foreign Application Priority Data

Jun. 2, 1993 [JP] Japan ..... 5-156066

[51] Int. Cl.[6] ..... G09G 3/20

[52] U.S. Cl. ..... 345/149; 345/89; 345/147

[58] Field of Search ..... 345/89, 95, 96, 345/147, 148, 149, 87; 358/458, 455, 456

[56] References Cited

U.S. PATENT DOCUMENTS 4,571,585 2/1986 Stein et al. ..... 345/96
4,827,255 5/1989 Ishii ..... 345/148

FOREIGN PATENT DOCUMENTS

0400992A2 12/1990 European Pat. Off. .
0484159 10/1991 European Pat. Off. ..... 345/89

*Primary Examiner*—Richard Hjerpe
*Assistant Examiner*—Kent Chang
*Attorney, Agent, or Firm*—Whitham, Curtis, Whitham & McGinn

[57] ABSTRACT

In a liquid crystal display driving method, a first and positive voltage and a second and negative voltage are applied for displaying a first brightness level, respectively, and a third and positive voltage and a fourth and negative voltage are applied for displaying a second brightness level, respectively. In each unitary pixel block composed of two rows and two columns, a driving voltage is applied in such a manner that in each of four continuous frames, the first to fourth voltages are always applied to four pixels of the unitary pixel block, but in the four continuous frames, the four voltages are applied to each pixel in the order of the first to fourth voltages but in a phase different from the phase for each of the remaining three pixels. Thus, the four-frame thinning out system can be performed for displaying a halftone, with a minimized flicker.

20 Claims, 5 Drawing Sheets

METHOD FOR DRIVING LIQUID CRYSTAL DISPLAY PANEL, WITH REDUCED FLICKER AND WITH NO STICKING

BACKGROUND OF THE INVENTION

1. Field of the Invention

The present invention relates to a method for driving a liquid crystal display panel, and more specifically to a liquid crystal display driving method capable of displaying a halftone image.

2. Description of Related Art

Liquid crystal displays are increasingly used as a display in personal computers, work stations, word processors, and the like, since they have a feature of being compact and having low power consumption.

As means for displaying an image with a plurality of gradation levels, a frame thinning out system has been known, in which a unitary period is composed of a plurality of continuous frames which can have different brightness, so that a halftone can be displayed. For example, this frame thinning out system is disclosed in European Patent Publication EP-A-0400992, the disclosure of which is incorporated by reference in its entirety into this application.

Here, a liquid crystal display driving method for displaying a halftone image in accordance with a conventional frame thinning out system, will be described with reference to FIGS. 1A to 1C and 2. FIGS. 1A to 1C show a change in brightness for images having different gradation levels, and FIG. 2 illustrates a distribution of brightness in a display region composed of pixels arranged in two rows and two columns.

FIG. 1A shows a change in brightness for an image having the gradation level 1, and FIG. 1B shows a change in brightness for an image having the gradation level 2. FIG. 1C shows a change in brightness for an image having the gradation level 3. Here, each of the gradation levels 1 and 3 is a reference brightness, and in the case of displaying an image, having the gradation level 1 or 3, the brightness is constant over all frames.

On the other hand, in the case of displaying an image having the gradation level 2, the brightness for the gradation level 1 and the brightness for the gradation level 3 are alternately displayed, frame by frame, as shown in FIG. 1B.

The frame frequency is 60 Hz in a display for a television, a personal computer, etc. In the ease of displaying an image having the gradation level 2, the brightness is caused to change, frame by frame, as shown in FIG. 1B. Therefore, a flicker having a frequency of one haft of one frame frequency occurs, so that the quality of the display is deteriorated.

As a means for suppressing this flicker, one method is known in which the brightness levels 1 and 3 are displayed in adjacent pixels, respectively, in each frame, as shown in FIG. 2, so that the flicker component is spatially equalized so as to be made quiet. Specifically, the pixels at positions of a row "n" and a column "m" and a row "n+1" and a column "m+l" are driven in a phase starting from "a" in FIG. 1B, and the pixels at positions of a row n+1" and a column "m" and a row "n" and a column "m+1" are driven in a phase starting from "b" in FIG. 1B.

In the meanwhile, the liquid crystal has the nature that if a voltage of the same polarity is applied for a long period of time, the liquid is deteriorated. Therefore, it is an ordinary practice to adopt an alternating current driving for the liquid crystal display.

Referring to FIG. 3, there is shown an example of the actual alternating current driving voltage waveform in the case of changing the brightness as shown in FIG. 1B. Here, it is assumed that the liquid crystal is in a normally white mode, and therefore, a high voltage is applied for the brightness level 1, and a low voltage is applied for the brightness level 3. Accordingly, in the case of displaying the image at the gradation level 2, the high voltage for the brightness level 1 is applied for a first frame (frame 1), and then, the low voltage for the brightness level 3 is applied for a second frame (frame 2). This voltage application pattern is repeatedly performed, so that the a halftone image having the gradation level 2 can be displayed.

Furthermore, if a dot-inverting driving method is adopted in which the polarity of the voltage applied to adjacent pixels is made opposite to each other, the flicker can be adequately suppressed.

The halftone display method as shown in FIG. 3 of displaying one halftone by use of two frames, is called a two-frame thinning out system.

However, in the halftone display method in accordance with the conventional two-frame thinning out system, the voltage applied in the odd-numbered frames (Frames 1, 3, 5, . . . ) is asymmetric to the voltage applied in the even-numbered frames (Frames 2, 4, . . . ). Therefore, a direct current voltage is applied to the liquid crystal, with the result that an image sticking occurs and furthermore, the lifetime of the liquid display is reduced.

SUMMARY OF THE INVENTION

Accordingly, it is an object of the present invention to provide a liquid crystal display driving method which has overcome the above mentioned defect of the conventional one.

For the purpose of displaying the gradation level 2 with symmetric voltages, it can be considered to adopt a four-frame thinning out system.

Referring to FIG. 4, there is shown a waveform diagram illustrating a symmetric voltage driving method of the four-frame thinning out system. In the shown example, a high positive voltage is applied in a first frame, a high negative voltage is applied in a second frame, a low positive voltage is applied in a third frame, and a low negative voltage is applied in a fourth frame, so that the gradation level 1 is displayed by the first and Second frames, and the gradation level 3 is displayed by the third and fourth frames. As a result, the gradation level 2 is displayed as the whole of the first to fourth frames.

Referring to FIG. 5, there is shown a change with time in brightness in the case of changing the applied voltage as shown in FIG. 4, in a twisted nematic liquid crystal, display which are used in ordinary cases. Since the twisted nematic liquid crystal has a response speed on the order of several tens of milliseconds or more, the brightness cannot reach a stable condition during the period of one frame.

However, when the above mentioned four-frame thinning-out driving method was used in a TFT (thin film transistor) active matrix liquid crystal display, occurrence of remarkable flickers was observed. In the case of the four-frame thinning out driving method, the brightness in each pixel changes in brightness with a frequency that is one fourth of the frame frequency. Because of this, the remarkable flicker would be observed.

Therefore, another object of the present invention is to provide a liquid crystal display driving method which is based on the four-frame thinning out driving system so as to avoid asymmetry of the voltage applied to the liquid crystal and to prevent sticking of an image and deterioration of the liquid crystal itself, and which is configured to cause no difference in brightness in each unitary block composed of a plurality of pixels, from one frame to another, so that a flicker is effectively minimized.

The above and other objects of the present invention are achieved in accordance with the present invention by a method for driving a liquid crystal display composed of a plurality of pixels arranged in a matrix having a plurality of rows and a plurality of columns, the method being such that in two continuous frames of each four continuous frames, a first and positive voltage and a second and negative voltage are alternately applied to a pixel for displaying a first brightness, and in the remaining two continuous frames, a third and positive voltage and a fourth and negative voltage are alternately applied to the pixel for displaying a second brightness different from the first brightness, so that a halftone between the first brightness and the second brightness is displayed, wherein, in each unitary pixel block composed of pixels arranged in two rows and in two columns, all of the first to fourth voltages are sequentially applied to each pixel in the four continuous frames in such a manner that one voltage is applied in one frame, and the first to fourth voltages am simultaneously applied to four pixels of the unitary pixel block in each frame of the four continuous frames.

The above and other objects, features and advantages of the present invention will be apparent from the following description of preferred embodiments of the invention with reference to the accompanying drawings.

BRIEF DESCRIPTION OF THE INVENTION

DESCRIPTION OF THE PREFERRED EMBODIMENT

Figure 1A:
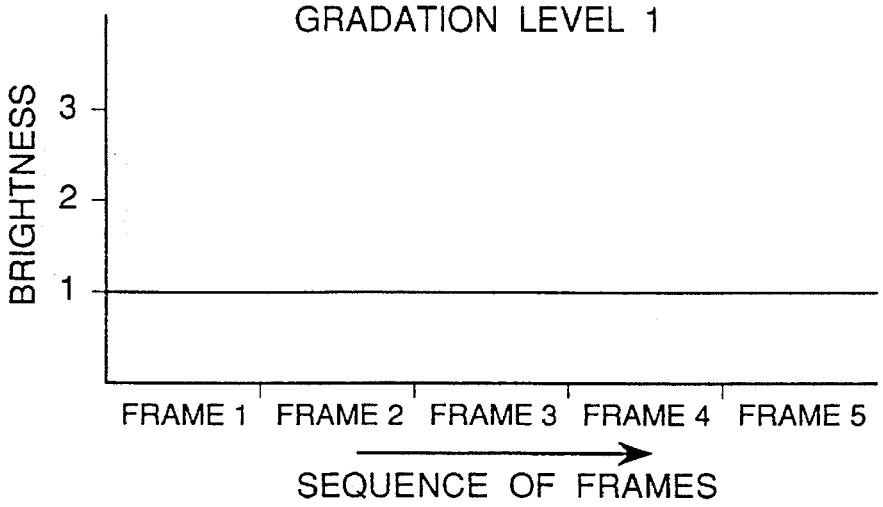
FIGURE 1A PRIOR ART
FIGS. 1A to 1C show a change in brightness for images having a different gradation levels.
Figure 1B:
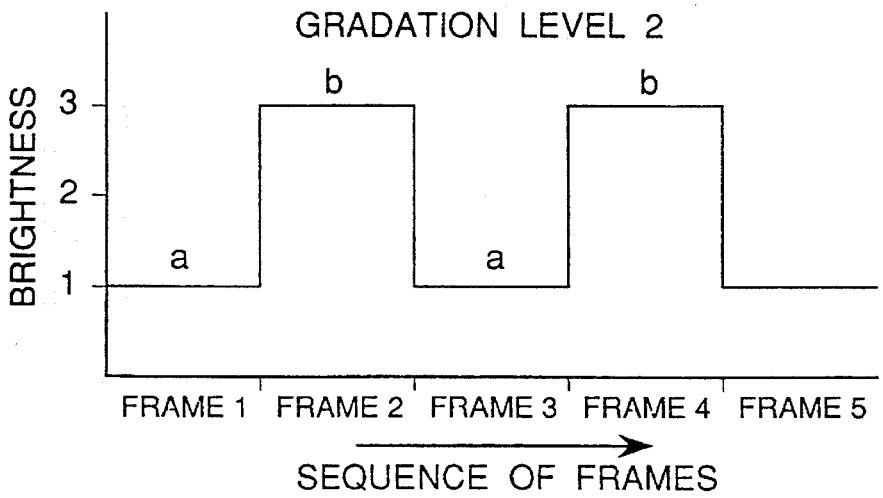
FIGURE 1B PRIOR ART
Figure 1C:
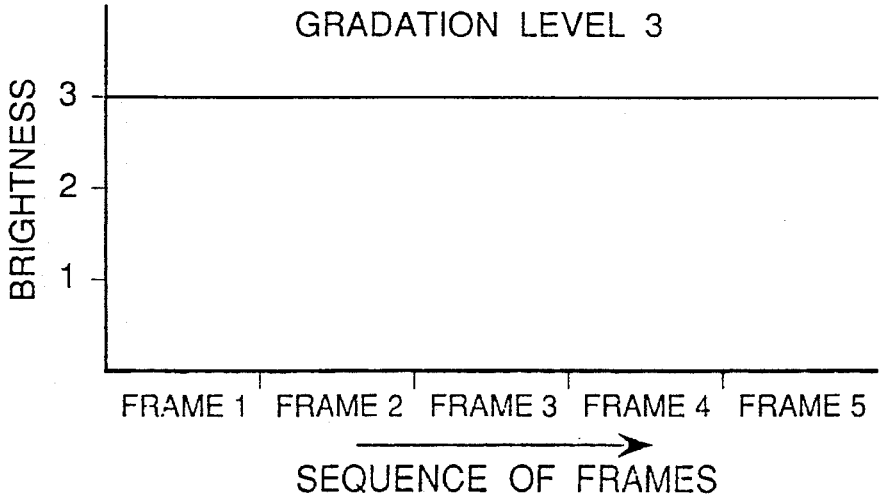
FIGURE 1C PRIOR ART
Figure 2:
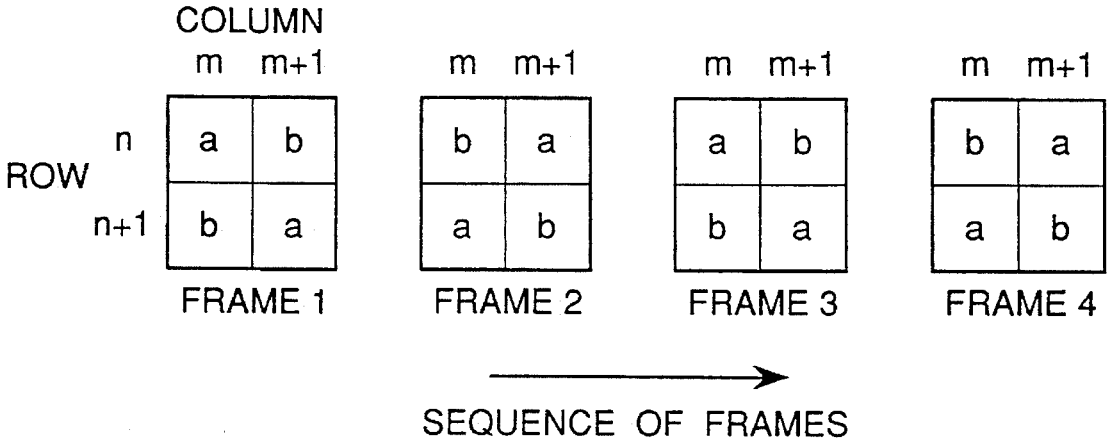
FIGURE 2 PRIOR ART
FIG. 2 illustrates a distribution of brightness in a display region composed of pixels arranged in two rows and two columns.
Figure 3:
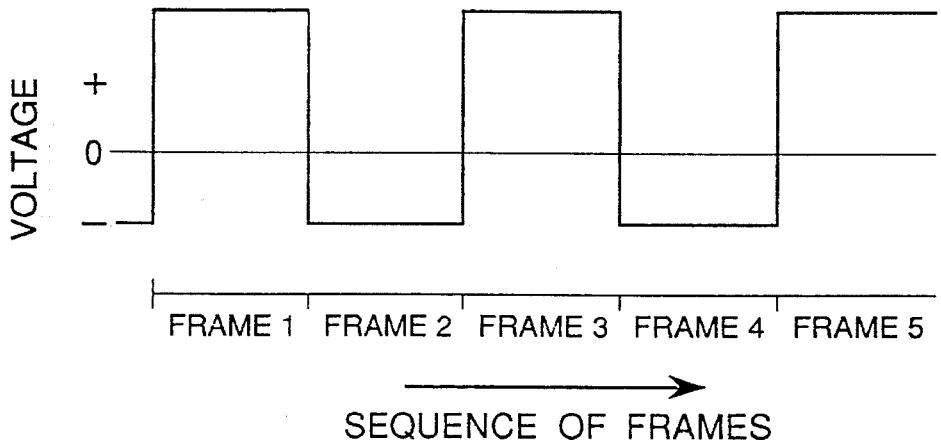
FIGURE 3 PRIOR ART
FIG. 3 is a voltage waveform diagram showing an example of the actual alternating current driving voltage applied in the ease of changing the brightness as shown in FIG. 1B.
Figure 4:
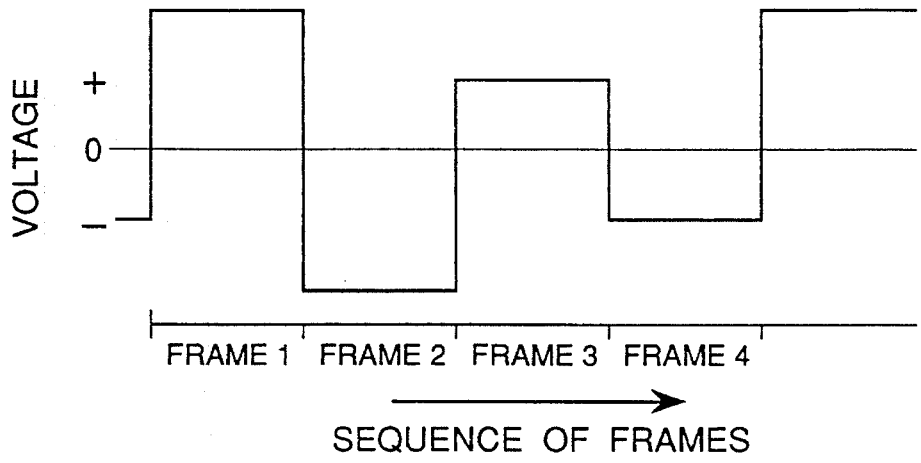
FIG. 4 is a waveform diagram illustrating a symmetric voltage driving method of the four-frame thinning out system.
Figure 6:
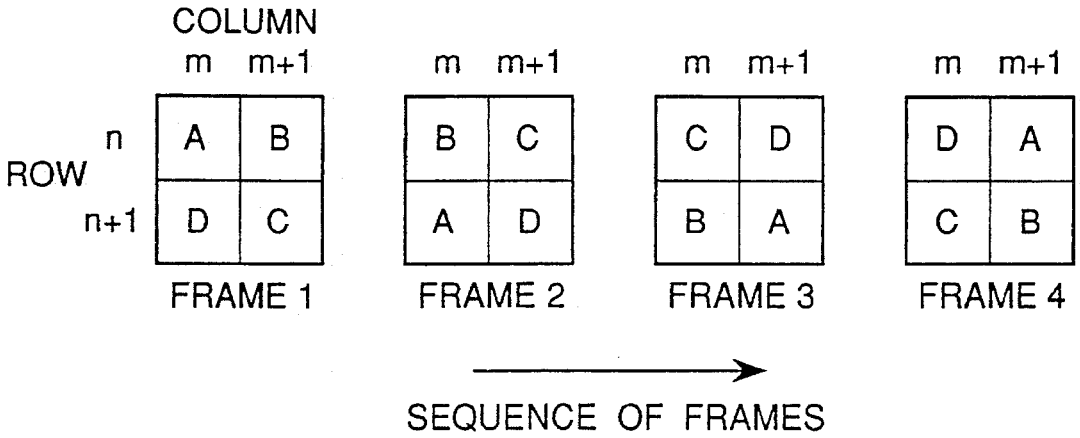
FIG. 6 illustrates a brightness change sequence in respective pixels of a unitary pixel block in accordance with a first embodiment of the liquid crystal display driving method in accordance with the present invention.

Referring to FIG. 6, there is illustrated a brightness change sequence in respective pixels of a unitary pixel block composed of pixels arranged in two rows and in two columns, starting from an (n)th row and an (m)th column in a pixel matrix of a liquid crystal display, in accordance with a first embodiment of the liquid crystal display driving method in accordance with the present invention. In this first embodiment, each pixel is driven in accordance with the four-frame symmetric driving voltage as illustrated in FIG. 4. Namely, a high positive voltage is applied in a first frame, a high negative voltage is applied in a second frame, a low positive voltage is applied in a third frame, and a low negative voltage is applied in a fourth frame, so that the gradation level 1 is displayed by the first and second frames, and the gradation level 3 is displayed by the third and fourth frames.

Figure 5:
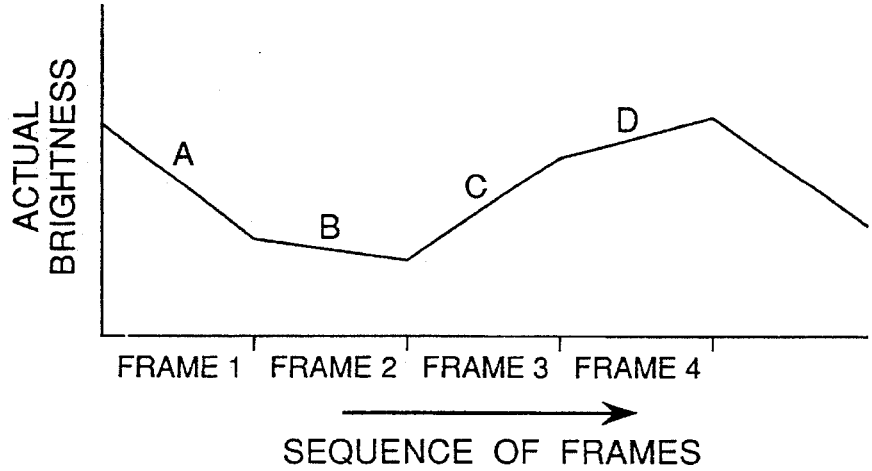
FIG. 5 shows a change with time in actual brightness in the case of changing the applied voltage as shown in FIG. 4, in a twisted nematic liquid crystal display.

In this driving method, since the response time of the liquid crystal is longer than one frame time, the actual brightness changes as shown in FIG. 5. As will be understood from FIG. 5, the frames 1 and 2 are different in mean actual brightness, and the frames 3 and 4 are different in mean actual brightness. Here, the mean actual brightness in the first, second, third and fourth frames will be called "A", "B", "C" and "D", respectively. These brightness "A", "B", "C" and "D" correspond to the brightness "A", "B", "C" and "D" indicated within each pixel of the unitary pixel block shown in FIG. 6.

In this first embodiment, as shown in FIG. 6, the brightness of each pixel changes as follows in the sequence of frames:

| | |
|---|---|
| Pixel position (m, n) | A → B → C → D → A → |
| Pixel position (m + 1, n) | B → C → D → A → B → |
| Pixel position (m + 1, n + 1) | C → D → A → B → C → |
| Pixel position (m, n + 1) | D → A → B → C → D → |

If the driving voltage for realizing the above mentioned brightness change can be expressed by the frame number as shown in FIG. 4, the following can be obtained:

| | |
|---|---|
| Pixel position (m, n) | 1 → 2 → 3 → 4 → 1 → |
| Pixel position (m + 1, n) | 2 → 3 → 4 → 1 → 2 → |
| Pixel position (m + 1, n + 1) | 3 → 4 → 1 → 2 → 3 → |
| Pixel position (m, n + 1) | 4 → 1 → 2 → 3 → 4 → |

In this case, a dot-inverting driving method in which the driving voltages applied to adjacent pixels is opposite in polarity to each other, is realized.

As seen from FIG. 6, in the first embodiment, the unitary pixel block composed of pixels arranged in two rows and in two columns always contains all of the brightness "A", "B", "C" and "D" in each frame. Therefore, a flicker component is mutually cancelled in four pixels adjacent to each other in a two-dimension space. Accordingly, mean actual brightness per frame becomes the same. As a result, even if the brightness of each pixel changes in a frequency of 15 Hz, this change of brightness cannot be visually recognized as a flicker.

The above mentioned driving method was applied to an 8.9 inch type active matrix liquid crystal display of 640×400 pixels, and a frequency component included in the brightness was analyzed by using a spectrum analyzer. A difference between the DC component and the AC component of a frequency of 50 Hz or less, which can be visually recognized as a flicker, was 0 dB in the conventional four-frame driving me/hod. Namely, the conventional four-frame driving method have a large flicker component. In the above mentioned driving method of the first embodiment, on the other hand, the difference was −20 dB or less. The flicker could not be visually recognized at all.

Figure 7:
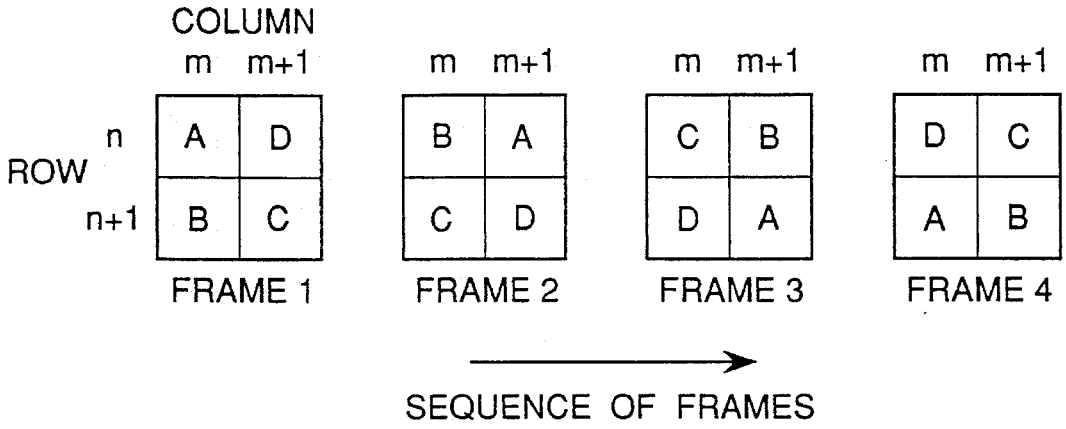
FIG. 7 illustrates a brightness change sequence in respective pixels of a unitary pixel block in accordance with a second embodiment of the liquid crystal display driving method in accordance with the present invention.

Referring to FIG. 7, a brightness change sequence in respective pixels of a unitary pixel block in accordance with a second embodiment of the liquid crystal display driving method in accordance with the present invention is illustrated.

As will be apparent from comparison between FIGS. 6 and 7, the second embodiment is one obtained by exchanging allocation of the brightness change pattern to the four adjacent pixels. In this second embodiment, the unitary pixel block always contains all of the brightness "A", "B", "C" and "D" in each frame, similarly to the first embodiment. Therefore, an effect similar to that obtained in the first embodiment can be obtained.

Figure 8:
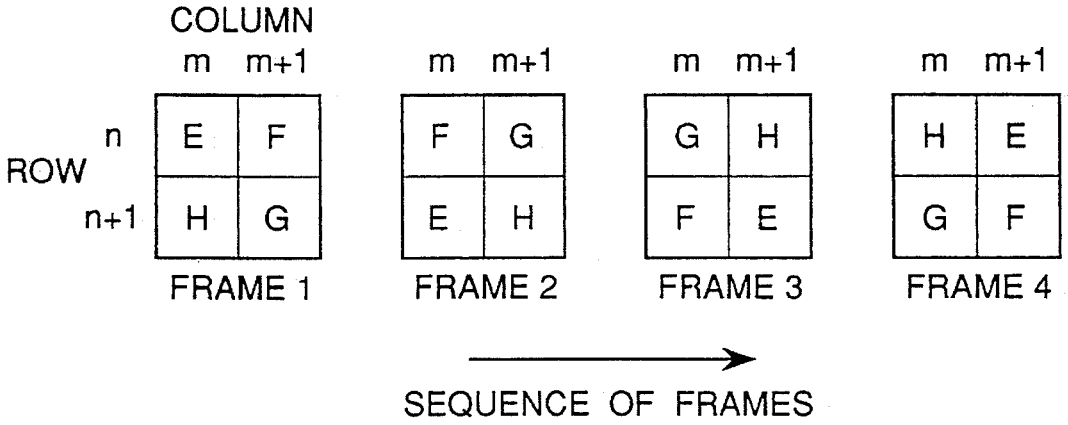
FIG. 8 illustrates a brightness change sequence in respective pixels of a unitary pixel block in accordance with a third embodiment of the liquid crystal display driving method in accordance with the present invention.
Figure 9:
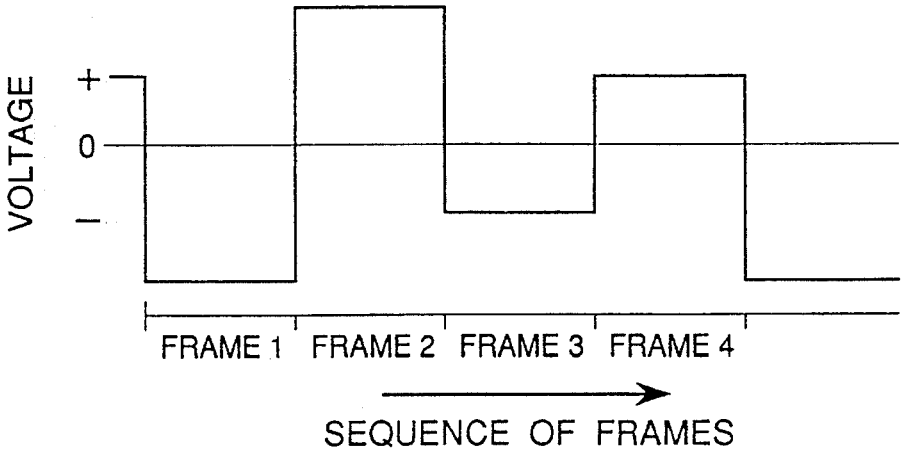
FIG. 9 is a waveform diagram illustrating a driving voltage sequence applied in accordance with the third embodiment of the liquid crystal display driving method.

Now, a third embodiment of the liquid crystal display driving method in accordance with the present invention will be described with reference to FIGS. 8, 9 and 10. FIG. 8 illustrates a brightness change sequence in respective pixels of a unitary pixel block composed of pixels arranged in two rows and in two columns, starting from an (n)th row and an (m)th column in a pixel matrix of a liquid crystal display, in accordance with a third embodiment of the liquid crystal display driving method in accordance with the present invention. FIG. 9 is a waveform diagram illustrating a driving voltage sequence applied in accordance with the third embodiment of the liquid crystal display driving method.

As will be seen from FIG. 9, differently from the first embodiment, the third embodiment is such that, a high negative voltage is applied in a first frame, a high positive voltage is applied in a second frame, a low negative voltage is applied in a third frame, and a low positive voltage is applied in a fourth frame, so that the gradation level 1 is displayed by the first and second frames, and the gradation level 3 is displayed by the third and fourth frames.

Figure 10:
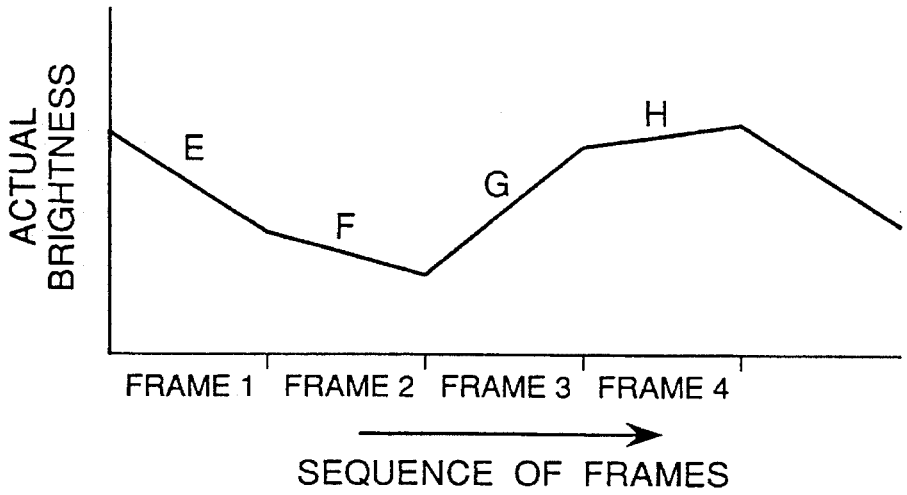
FIG. 10 shows a change with time in actual brightness in the case of changing the applied voltage as shown in FIG. 9, in a twisted nematic liquid crystal display.

Referring to FIG. 10, there is shown a change with time in actual brightness in the case of changing the applied voltage in a twisted nematic liquid crystal display in the sequence as shown in FIG. 9. Since the response time of the liquid crystal is longer than one frame time, the frames 1 and 2 are different in mean actual brightness, and the frames 3 and 4 are different in mean actual brightness. Here the mean actual brightness in the first, second, third and fourth frames will be called "E", "F", "G" and "H", respectively. These brightness "E", "F", "G" and "H" correspond to the brightness "E", "F", "G" and "H" indicated in each pixel of the unitary pixel block shown in FIG. 8.

In this third embodiment, as shown in FIG. 8, the brightness of each pixel changes as follows in the sequence of frames:

| | |
|---|---|
| Pixel position (m, n) | E → F → G → H → E → |
| Pixel position (m + 1, n) | F → G → H → E → F → |
| Pixel position (m + 1, n + 1) | G → H → E → F → G → |
| Pixel position (m, n + 1) | H → E → F → G → H → |

If the driving voltage for realizing the above mentioned brightness change can be expressed by the frame number as shown in FIG. 9, the following can be obtained:

| | |
|---|---|
| Pixel position (m, n) | 1 → 2 → 3 → 4 → 1 → |
| Pixel position (m + 1, n) | 2 → 3 → 4 → 1 → 2 → |
| Pixel position (m + 1, n + 1) | 3 → 4 → 1 → 2 → 3 → |
| Pixel position (m, n + 1) | 4 → 1 → 2 → 3 → 4 → |

Also in this case, a dot-inverting driving method in which the driving voltages applied to adjacent pixel is opposite in polarity to each other, is realized.

As seen from FIG. 8, in the third embodiment, the unitary pixel block composed of pixels arranged in two rows and in two columns always contains all of the brightness "E", "F", "G" and "H" in each frame. Therefore, a flicker component is mutually cancelled in four pixels adjacent to each other in a two-dimension space. Accordingly, the mean actual brightness per frame becomes the same. As a result, an effect similar to that obtained in the first embodiment can be obtained.

Figure 11:
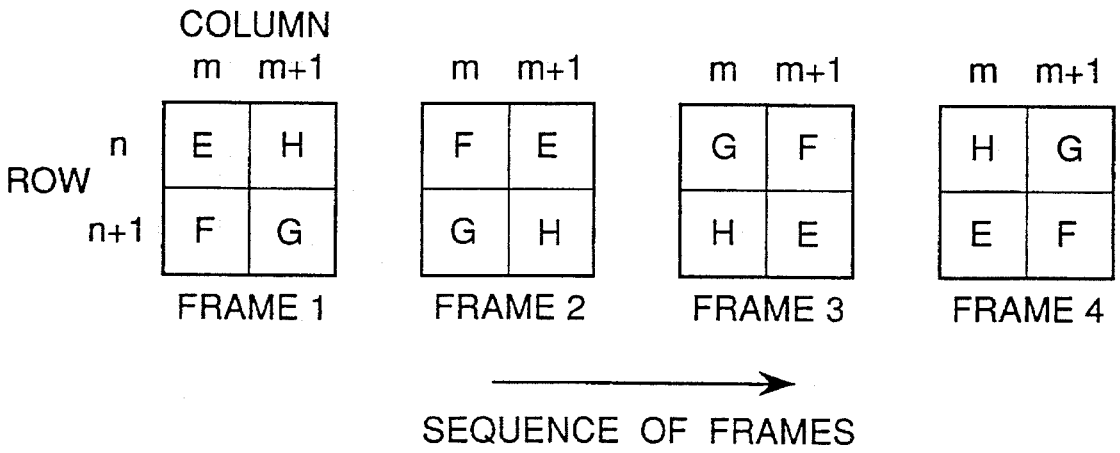
FIG. 11 illustrates a brightness change sequence in respective pixels of a unitary pixel block in accordance with a fourth embodiment of the liquid crystal display driving method in accordance with the present invention.

Referring to FIG. 11, a brightness change sequence in respective pixels of a unitary pixel block in accordance with a fourth embodiment of the liquid crystal display driving method in accordance with the present invention is illustrated.

As will be apparent from a comparison between FIGS. 8 and 11, the fourth embodiment is one obtained by exchanging allocation of the brightness change pattern to the four adjacent pixels in the third embodiment. In this fourth embodiment, the unitary pixel block always contains all of the brightness "E", "F", "G" and "H" in each frame, similarly m the third embodiment, Therefore, an effect similar to that obtained in the third embodiment can be obtained.

Incidentally, the brightness "A", "B", "C" and "D" in the actual brightness change of the one pixel shown in FIG. 5 obtained by the driving voltage sequence shown in FIG. 4 am slightly different from the brightness "E", "F", "G" and "H" in the actual brightness change of the one pixel shown in FIG. 10 obtained by the driving voltage sequence shown in FIG. 9. The cause of this can be considered to be that, in the case of an active matrix liquid crystal display, the thin film transistors acting as a switching element have a parasitic capacitance, and the driving voltage waveform in positive polarity becomes asymmetric to the driving voltage waveform in negative polarity, because of the parasitic capacitance and other factors, with the result that the change in brightness does not become the same. Accordingly, if the driving method shown in FIG. 5 and the driving method shown in FIG. 9 are mixed, a flicker will occur. In the present invention, since the voltage waveform applied to each pixel are the same although it is different in phase, the flicker will not occur.

The driving method in accordance with the present invention has been described in a black-and-white liquid crystal display, but it should be understood that the driving method in accordance with the present invention can be applied to a color liquid crystal display. In addition, the shown embodiment was directed to the case of displaying a half tone from two gradation levels. However, the present invention can be applied to the case of performing the frame thinning out system in a multitone display such as a 8-gradation level display or a 16-gradation level display.

As will be apparent from the above, the liquid crystal display driving method in accordance with the present invention is characterized in that, there is adopted the four-frame thinning out system applying a pair of positive and negative voltages for each one reference gradation level in such a manner that in each of four continuous frames, four different voltages are always applied to four pixels of each one unitary pixel block composed of two rows and two columns, while the four different voltages are sequentially applied to each of the four pixels in four continuous frames. With this arrangement, no DC voltage is applied to the liquid crystal, so that the deterioration of the liquid crystal is prevented and the sticking of the image is avoided. In addition, the flicker component is cancelled in the four pixels of each unitary pixel block, and therefore, the occurrence of the flicker can be minimized.

The invention has thus been shown and described with reference to the specific embodiments. However, it should be noted that the present invention is in no way limited to the details of the illustrated structures but changes and modifications may be made within the scope of the appended claims.

I claim:

1. A method for driving a liquid crystal display comprising a plurality of pixels arranged in a matrix having a plurality of rows and a plurality of columns, the method comprising steps of:

alternately applying, in two continuous frames of each four continuous frames, a first, positive voltage and a second, negative voltage to a pixel for displaying a first brightness; and alternately applying, in the remaining two continuous frames, a third, positive voltage and a fourth, negative voltage to the pixel for displaying a second brightness different from said first brightness, so that a halftone between said first brightness and said second brightness is displayed, wherein, in each unitary pixel block comprising pixels arranged in two rows and in two columns, all of said first to fourth voltages are sequentially applied to each pixel in said four continuous frames such that one voltage is applied in one frame, and said first to fourth voltages are simultaneously applied to four pixels of the unitary pixel block in each frame of said four continuous flames.

2. A method as claimed in claim 1 wherein said first to fourth voltages are applied to each pixel in the named order of said first voltage, said second voltage, said third voltage and said fourth voltage.

3. A method as claimed in claim 1 wherein said first to fourth voltages are applied to each pixel in the named order of said second voltage, said first voltage, said fourth voltage and said third voltage.

4. A method according to claim 1, wherein a voltage of said first, positive voltage is greater than a voltage of said third, positive voltage.

5. A method according to claim 4, wherein a voltage of said second, negative voltage is greater than a voltage of said fourth, negative voltage such that said brightness displayed by said first and second frames has a first gradation and said brightness displayed by said third and fourth frames has a second gradation, and such that a brightness having a third gradation is displayed a whole by said first to said fourth frames, wherein said brightness having said third gradation is intermediate to that of said first and second brightnesses.

6. A method according to claim 1, wherein said unitary pixel block includes a plurality of brightnesses in each frame, such that a flicker component of four adjacent pixels of said unitary pixel block is mutually cancelled and such that a mean actual brightness per frame becomes a same value.

7. A method according to claim 1, wherein voltage waveforms respectively applied to each pixel of said unitary pixel block have a same value and a different phase, so as to prevent flickering in said liquid crystal display.

8. A method according to claim 1, wherein said first voltage, said second voltage, said third voltage, and said fourth voltage each have a different value and are sequentially applied to four pixels of said unitary pixel block in four continuous frames.

9. A method according to claim 1, wherein said liquid crystal display is devoid of a direct current (DC) voltage being applied thereto.

10. A method according to claim 2, wherein a voltage of said first, positive voltage is greater than a voltage of said third, positive voltage.

11. A method according to claim 10, wherein a voltage of said second, negative voltage is greater than a voltage of said fourth, negative voltage such that said brightness displayed by said first and second frames has a first gradation and said brightness displayed by said third and fourth frames has a second gradation, and such that said halftone having a brightness having a third gradation is displayed a whole by said first to said fourth frames, wherein said brightness having said third gradation is intermediate to that of said first and second brightnesses.

12. A method according to claim 2, wherein said unitary pixel block includes a plurality of brightnesses in each frame, such that a flicker component of four adjacent pixels of said unitary pixel block is mutually cancelled and such that a mean actual brightness per frame becomes a same value.

13. A method according to claim 2, wherein voltage waveforms respectively applied to each pixel of said unitary pixel block have a same value and a different phase, so as to prevent flickering in said liquid crystal display.

14. A method according to claim 2, wherein said first voltage, said second voltage, said third voltage, and said fourth voltage each have a different value and are sequentially applied to four pixels of said unitary pixel block in four continuous frames.

15. A method according to claim 2, wherein said liquid crystal display is devoid of a direct current (DC) voltage being applied thereto.

16. A method according to claim 3, wherein a voltage of said first, positive voltage is greater than a voltage of said third, positive voltage.

17. A method according to claim 16, wherein a voltage of said second, negative voltage is greater than a voltage of said fourth, negative voltage such that said brightness displayed by said first and second frames has a first gradation and said brightness displayed by said third and fourth frames has a second gradation, and such that a brightness having a third gradation is displayed a whole by said first to said fourth frames, wherein said brightness having said third gradation is intermediate to that of said first and second brightnesses.

18. A method according to claim 3, wherein said unitary pixel block includes a plurality of brightnesses in each frame, such that a flicker component of four adjacent pixels of said unitary pixel block is mutually cancelled and such that a mean actual brightness per frame becomes a same value.

19. A method according to claim 3, wherein voltage waveforms respectively applied to each pixel of said unitary pixel block have a same value and a different phase, so as to prevent flickering in said liquid crystal display.

20. A method according to claim 3, wherein said first voltage, said second voltage, said third voltage, and said fourth voltage have a different value and are sequentially applied to four pixels of said unitary pixel block in four continuous frames, wherein said liquid crystal display is devoid of a direct current (DC) voltage being applied thereto.

* * * * *